US006748683B1

(12) United States Patent
Schultz

(10) Patent No.: US 6,748,683 B1
(45) Date of Patent: Jun. 15, 2004

(54) BOAT ANTENNA FLAG SYSTEM

(76) Inventor: Phillip Alonzo Schultz, 723 West Bay Dr., Largo, FL (US) 33770

( * ) Notice: Subject to any disclaimer, the term of this patent is extended or adjusted under 35 U.S.C. 154(b) by 11 days.

(21) Appl. No.: 10/172,374

(22) Filed: Jun. 14, 2002

(51) Int. Cl.[7] ..... G09F 17/00
(52) U.S. Cl. ..... 40/218; 40/541
(58) Field of Search ..... 40/591, 218, 592; 116/173; D11/165, 166, 181

(56) References Cited

U.S. PATENT DOCUMENTS 3,812,815 A * 5/1974 Kuenzel ..... 116/173
4,796,553 A * 1/1989 Cogswell et al. ..... 116/173
4,934,972 A * 6/1990 Shumway et al. ..... 116/173
5,253,608 A * 10/1993 Burke ..... 116/173
5,291,849 A * 3/1994 Zeitler ..... 116/174
5,943,980 A * 8/1999 Huang ..... 116/173
5,975,009 A * 11/1999 Nihra et al. ..... 116/173

* cited by examiner

*Primary Examiner*—Gary Hoge
(74) *Attorney, Agent, or Firm*—Edward P. Dutkiewicz

(57) ABSTRACT

A boat antenna flag system comprises a boat antenna, the boat antenna has a base end and a free end. A flag is provided. The flag has a free end and a fixed end. The fixed end has a plurality of apertures reinforced with grommets. A lower end retention device is also provided. The lower end retention device is adapted to set the height of the flag on the antenna. An upper end retention device is further provided. The upper end retention device is adapted to prevent the flag from coming off the antenna. Provided last is a one piece coupling device for the antenna, flag and retention devices.

3 Claims, 4 Drawing Sheets

FIG 3A
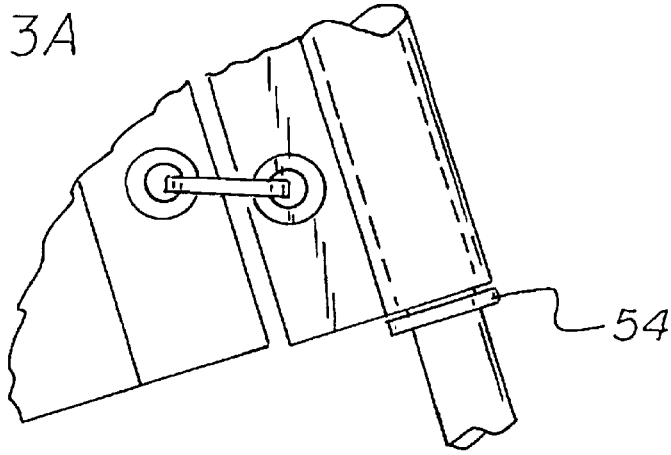
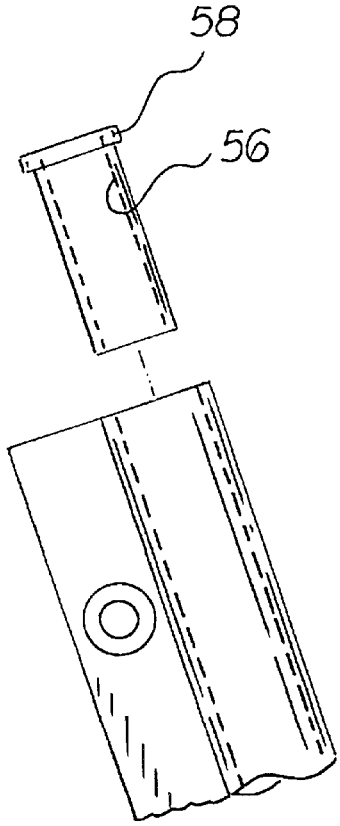
FIG 4

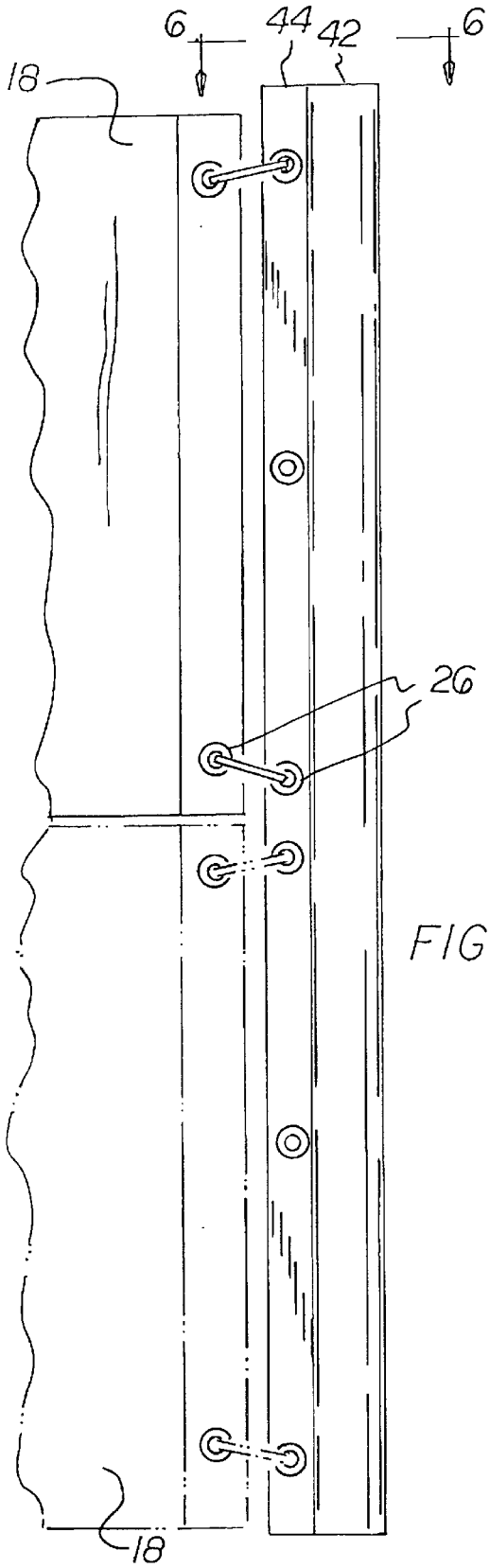
FIG 5
FIG 6
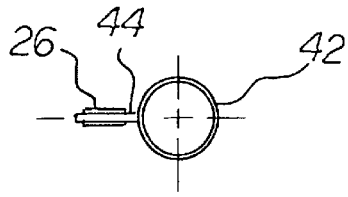

BOAT ANTENNA FLAG SYSTEM

BACKGROUND OF THE INVENTION

1. Field of the Invention

The present invention relates to a boat antenna flag system and more particularly pertains to rotatably coupling a flag to an antenna of a boat.

2. Description of the Prior Art

The use of flags for boats of known designs and configurations is known in the prior art. More specifically, flags for boats of known designs and configurations previously devised and utilized for the purpose of coupling devices of boats through conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,740,622 to Martin discloses an antenna mounted automobile and truck pennant. U.S. Pat. No. 4,934,972 to Shumway et al. discloses a water ski safety alarm. U.S. Pat. No. 4,962,720 to Leffel discloses a marine signal flag. Finally, U.S. Pat. No. 4,964,360 to Henry discloses an automobile locator.

While these devices fulfill their respective, particular objectives and requirements, the aforementioned patents do not describe a boat antenna flag system that allows rotatably coupling a flag to an antenna of a boat.

In this respect, the boat antenna flag system according to the present invention substantially departs from the conventional concepts and designs of the prior art, and in doing so provides an apparatus primarily developed for the purpose of rotatably coupling a flag to an antenna of a boat.

Therefore, it can be appreciated that there exists a continuing need for a new and improved boat antenna flag system which can be used for rotatably coupling a flag to an antenna of a boat. In this regard, the present invention substantially fulfills this need.

SUMMARY OF THE INVENTION

In view of the foregoing disadvantages inherent in the known types of flags for boats of known designs and configurations now present in the prior art, the present invention provides an improved boat antenna flag system. As such, the general purpose of the present invention, which will be described subsequently in greater detail, is to provide a new and improved boat antenna flag system and method which has all the advantages of the prior art and none of the disadvantages.

To attain this, the present invention essentially comprises a boat antenna. The boat antenna has a frustroconical shape including a lower base end and an upper free end. A flag is provided next. The flag is of a rectilinear configuration. The flag has a free end and a fixed end. The fixed end has a plurality of vertically spaced apertures. The apertures have grommets for reinforcement purposes. Next provided is a pair of bushings. Each pair has an end ring and a fixed internal diameter and external diameter. An elastic o-ring is further provided. The elastic o-ring has an internal diameter less than that of the boat antenna. Provided last is a one piece coupling device. The coupling device includes a cylinder. The coupling device includes a flange integrally extruded with the cylinder, a top end and a bottom end. The flange has a plurality of vertically spaced apertures. The apertures have grommets for reinforcement purposes. The spaced apertures and grommets of the flange are spaced such that corresponding grommets of the flange and the flag can be coupled with attachment means. A first bushing is provided. The first bushing is coupled to the boat antenna with the ring end of the bushing facing the base of the antenna and is fixed in place by the diameter of the bushing. Th coupling device and flag, when in combination, are positioned over the antenna and come to rest on the first bushing. A second bushing is provided. The second bushing is then threaded with the ring end facing up and secured in place by the O-ring.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved boat antenna flag system which has all of the advantages of the prior art flags for boats of known designs and configurations and none of the disadvantages.

It is another object of the present invention to provide a new and improved boat antenna flag system which may be easily and efficiently manufactured and marketed.

It is further an object of the present invention to provide a new and improved boat antenna flag system which is of durable and reliable constructions.

An even further object of the present invention is to provide a new and improved boat antenna flag system which is susceptible of a low cost of manufacture with regard to both materials and labor, and which accordingly is then susceptible of low prices of sale to the consuming public, thereby making such boat antenna flag system economically available to the buying public.

Even still another object of the present invention is to provide a boat antenna flag system for rotatably coupling a flag to an antenna of a boat.

Lastly, it is an object of the present invention to provide a new and improved boat antenna flag system comprises a boat antenna, the boat antenna has a base end and a free end. A flag is provided. The flag has a free end and a fixed end. The fixed end has a plurality of apertures reinforced with grommets. A lower end retention device is also provided. The lower end retention device is adapted to set the height of the flag on the antenna. An upper end retention device is further provided. The upper end retention device is adapted to prevent the flag from coming off the antenna. Provided last is a one piece coupling device for the antenna, flag and retention devices.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3A is an enlarged side elevational view of the lower portion of the system demonstrating an alternative embodiment.

FIG. 4 is an exploded side elevational view of the system shown in FIG. 2 but illustrating an alternate embodiment of the invention.

FIG. 5 is an enlarged elevational view of an alternate embodiment of the invention illustrating plural flags coupled together in one system.

FIG. 6 is an end elevational view taken along Line 6—6 of FIG. 5.

The same reference numerals refer to the same parts throughout the various Figures.

DESCRIPTION OF THE PREFERRED EMBODIMENT

Figure 1:
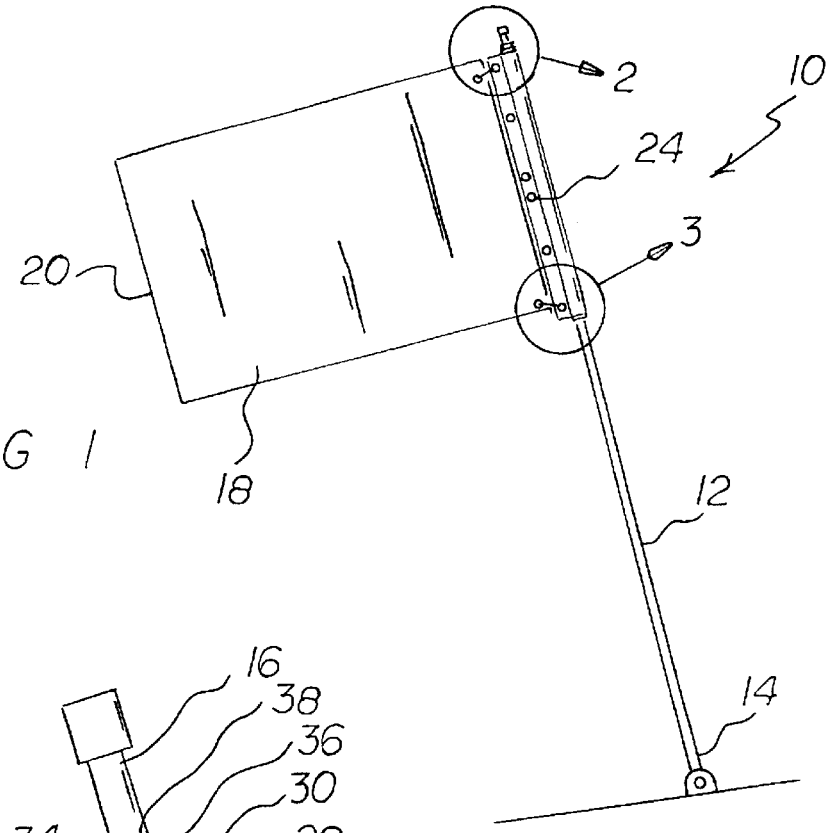
FIG. 1 is a side elevational view of the boat antenna flag system constructed in accordance with the principles of the present invention.
Figure 2:
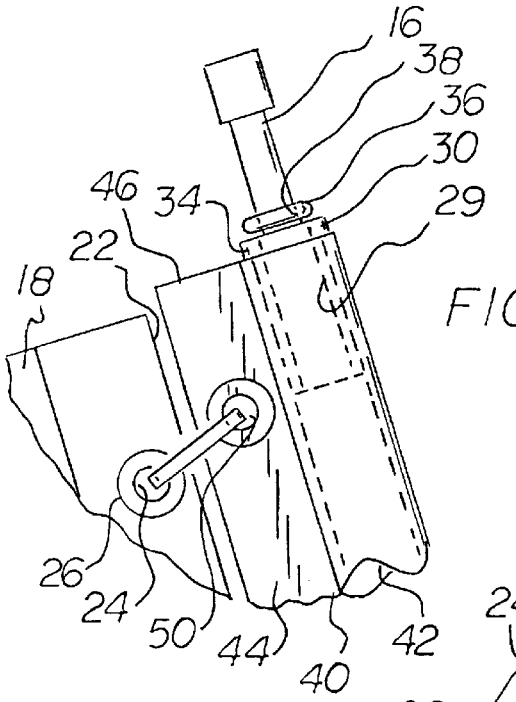
FIG. 2 is an enlarged side elevational view of the upper portion of the system taken at Circle 2 of FIG. 1.

With reference now to the drawings, and in particular to FIG. 1 thereof, the preferred embodiment of the new and improved boat antenna flag system embodying the principles and concepts of the present invention and generally designated by the reference numeral 10 will be described.

The present invention, the boat antenna flag system 10 is comprised of a plurality of components. Such components in their broadest context include a boat antenna, a flag, a lower end retention device, an upper end retention device, and a one piece coupling device. Such components are individually configured and correlated with respect to each other so as to attain the desired objective.

First provided is a boat antenna 12. The boat antenna has a frustroconical shape including a lower base end 14 and an upper free end 16.

A flag 18 is provided next. The flag is of a rectilinear configuration. The flag has a free end 20 and a fixed end 22. The fixed end has a plurality of vertically spaced apertures 24. The apertures have grommets 26 for reinforcement purposes.

Next provided is a pair of bushings 28–29. Each pair has an end ring 30 and a fixed internal diameter 32 and external diameter 34.

An elastic o-ring 36 is further provided. The elastic o-ring has an internal diameter 38 less than that of the boat antenna.

Provided last is a one piece coupling device 40. The coupling device includes a cylinder 42. The coupling device includes a flange 44 integrally extruded with the cylinder, a top end and 46 and a bottom end 48. The flange has a plurality of vertically spaced apertures 50. The apertures have grommets for reinforcement purposes. The spaced apertures and grommets of the flange are spaced such that corresponding grommets of the flange and the flag can be coupled with attachment means. A first bushing 29 is provided. The first bushing is coupled to the boat antenna with the ring end of the bushing facing the base of the antenna and is fixed in place by the diameter of the bushing. The coupling device and flag, when in combination, are positioned over the antenna and come to rest on the first bushing. A second bushing is provided. The second bushing is then threaded with the ring end facing up and secured in place by the O-ring.

Figure 3:
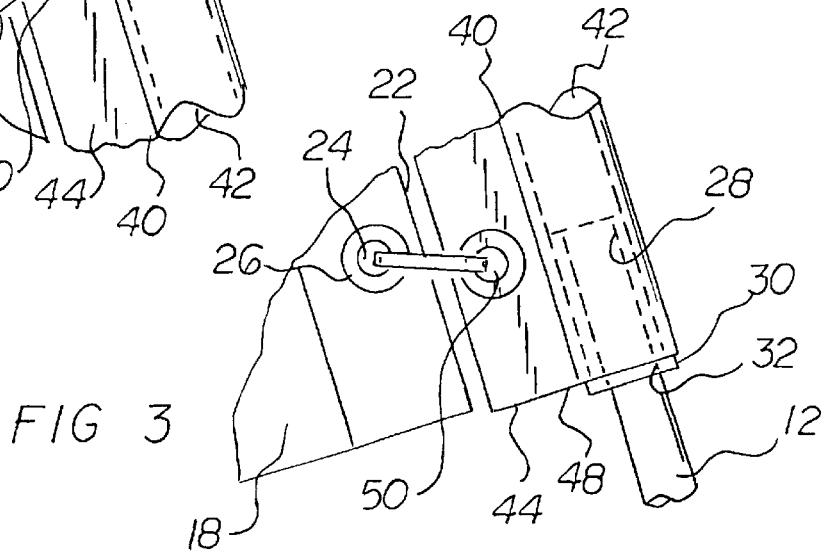
FIG. 3 is an enlarged side elevational view of the lower portion of the system taken at Circle 3 of FIG. 1.

An alternate embodiment of the invention is shown in FIGS. 3A and 4. In this embodiment, the system is adapted to fit on a larger boat antenna. The lower end retention device is a washer 54. The upper end retention device consists of a bushing 56 and an O-ring 58.

An alternate embodiment of the invention is shown in FIGS. 5 and 6. FIG. 5 is an enlarged elevational view of the alternate embodiment of the invention illustrating plural flags coupled together in one system. FIG. 6 is an end elevational view taken along line 6—6 of FIG. 5.

Figure 7:
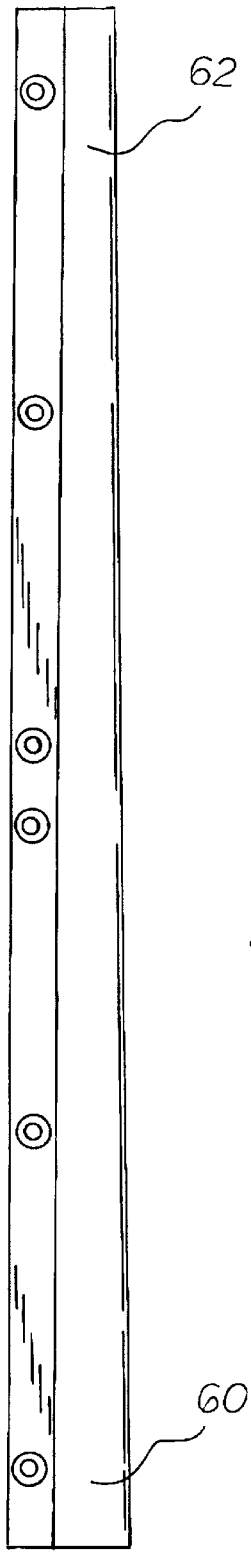
FIG. 7 is a side elevational view similar to FIG. 5 but excluding the flags and coupling components.

Another alternate embodiment of the invention is shown in FIG. 7. In this embodiment the cylindrical portion of the coupling device 60 is of a fustroconical shape to match the dimensions of the boat antenna 62. This embodiment negates the need for a lower end retention device.

Figure 8:
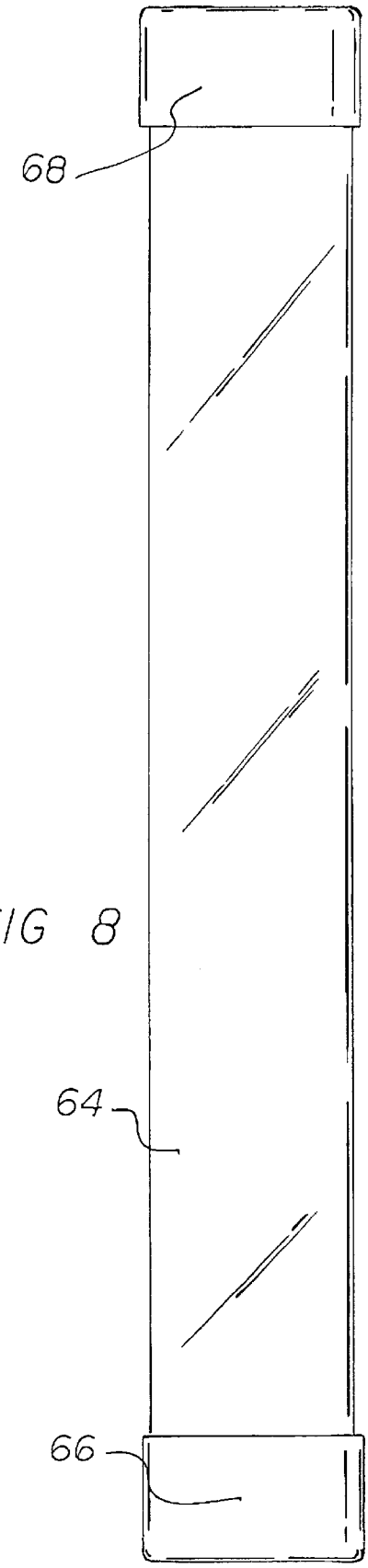
FIG. 8 is a final embodiment of the invention directed to a container for the system of any of the prior Figures.

FIG. 8 illustrates a final embodiment of the invention. In this final embodiment, the system can be disassembled and stored in a clear rigid plastic case 64. The case is in a cylindrical configuration with a fixed first end 66 and a removable second end 68.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A boat antenna flag system for rotatably coupling a flag to an antenna of a boat comprising, in combination:

a boat antenna having a frustroconical shape including a lower base end and an upper free end;

a flag of a rectilinear configuration having a free end and a fixed end, the fixed end having a plurality of vertically spaced apertures with grommets for reinforcement purposes;

a pair of bushings each with an end ring and a fixed internal diameter and external diameter;

an elastic o-ring having an internal diameter less than that of the boat antenna;

a one piece coupling device including a cylinder, a flange integrally extruded with the cylinder, a top end and a bottom end, the flange having a plurality of vertically spaced apertures with grommets for reinforcement purposes, the spaced apertures and grommets of the flange spaced such that corresponding grommets of the flange and the flag can be couple with attachment means, a first bushing being coupled to the boat antenna with the ring end of the bushing facing the base of the antenna and being fixed in place by the diameter of the bushing, whereby the coupling device and flag, when in combination, are positioned over the antenna and then come to rest on the first bushing, the second bushing being then threaded with the ring end facing up and secured in place by the O-ring.

2. A boat antenna flag system comprising:

a boat antenna with a base end and a free end;

a flag having a free end and a fixed end with the fixed end having a plurality of apertures reinforced with grommets;

a upper end retention device adapted to prevent the flag from coming off the antenna; and a one piece coupling device for the antenna, flag and retention devices, the coupling device being of a frustroconical shape to match the dimensions of the boat antenna negating the need for a lower end retention device.

3. A boat antenna flag system comprising:

a boat antenna with a base end and a free end;

a flag having a free end and a fixed end with the fixed end having a plurality of apertures reinforced with grommets;

a lower end retention device adapted to set the height of the flag on the antenna;

a upper end retention device adapted to prevent the flag from coming off the antenna;

a one piece coupling device for the antenna, flag and retention devices, the system being adapted to fit on a larger boat antenna and the lower end retention device comprising a washer and the upper end retention device comprising a bushing and an O-ring.

* * * * *